US005934883A

United States Patent [19]

Osterloff

[11] Patent Number: 5,934,883

[45] Date of Patent: Aug. 10, 1999

[54] PAINT SPRAYING DEVICE

[75] Inventor: Eckhard Osterloff, Friedrichshafen, Germany

[73] Assignee: J. Wagner GmbH, Freidrichshafen, Germany

[21] Appl. No.: 08/818,825

[22] Filed: Mar. 13, 1997

[30] Foreign Application Priority Data

Mar. 13, 1996 [DE] Germany ..... 196 09 896

[51] Int. Cl.[6] ..... F04B 23/00

[52] U.S. Cl. ..... 417/313; 417/360; 417/373; 417/423.8; 92/161

[58] Field of Search ..... 417/313, 362, 417/360, 373, 423.8; 92/161, 144

[56] References Cited

U.S. PATENT DOCUMENTS

| | | | |
|---|---|---|---|
| 4,810,169 | 3/1989 | Kranzle | 417/313 |
| 5,096,392 | 3/1992 | Greibel et al. | 417/360 |
| 5,360,322 | 11/1994 | Henein et al. | 417/313 |

FOREIGN PATENT DOCUMENTS

| | | | |
|---|---|---|---|
| 8805536 | 9/1988 | Germany . | |
| 195 14 316 | 8/1996 | Germany | 417/313 |
| 52-26601 | 2/1977 | Japan | 417/360 |
| 1148159 | 4/1969 | United Kingdom . | |

*Primary Examiner*—Charles G. Freay
*Assistant Examiner*—Cheryl J. Tyler
*Attorney, Agent, or Firm*—Robert W. Becker & Associates

[57] ABSTRACT

A paint spraying device has a housing with two halves and a hydraulic device mounted in the housing. The hydraulic device includes a valve system and a pump for conveying a medium to be sprayed. The pump is loaded by a hydraulic medium. A vertical plate flange has a first and second end and is connected by the first end to the hydraulic device. The second end of the vertical plate flange comprises a first support leg projecting from the housing. A drive motor is positioned in the housing for driving the pump and is connected to the vertical plate flange. The housing has at least one second support leg remote from the first support leg. The halves are fixedly connected to the hydraulic device.

20 Claims, 4 Drawing Sheets

PAINT SPRAYING DEVICE

BACKGROUND OF THE INVENTION

The invention relates to a paint spraying device with a conveying pump that is preferably embodied as a diaphragm pump and is loaded with a hydraulic pressure medium for conveying the medium to be sprayed. The pump together with the correlated valves forms a hydraulic device. A drive motor is drivingly connected to the conveying pump and is supported at the hydraulic device.

In a known paint spraying device of this kind, which has been successfully used in practice over a long period of time, the drive motor is drivingly connected with an eccentric disk to a piston which acts with a hydraulic linkage onto the diaphragm of the conveying pump. The drive members are enclosed in a housing part that is connected to the hydraulic device which has also secured thereto the drive motor.

In addition to the fact that the conveying pump and its drive members together with the housing in which they are received are of a large constructive size, it is also disadvantageous that the drive motor which is connected to one side of the housing must be additionally supported by an auxiliary frame. Furthermore, since the drive motor is connected by an eccentric disk to the conveying pump in order to provide driving action, a reduction of the rpm of the drive motor is not easily possible so that a four-pole electric motor must be provided as a drive which also requires a substantial constructive space and must be cooled by convection. In order to prevent the operating temperature within the hydraulic device from reaching a critical level, it is necessary to provide a correspondingly large oil volume and this also requires a large constructive space. The known paint spraying device thus is very heavy and difficult to manipulate.

It is therefore an object of the present invention to provide a paint spraying device of the aforementioned kind which is small and compact and can be produced inexpensively. In particular, one objective is that the paint spraying device should be mountable within a short period of time without difficulties and that a uniform distribution of the forces to be supported, especially when the device tips over, is provided. Moreover, the device should be easy to manipulate and should be adaptable without difficulties to different voltage networks so that it is suitable for numerous applications.

SUMMARY OF THE INVENTION

A paint spraying device according to the present invention is primarily characterized by:

A housing comprising two halves;

A hydraulic device mounted in the housing;

The hydraulic device including a valve system and a pump for conveying a medium to be sprayed;

The pump loaded by a hydraulic medium;

A vertical plate flange having a first and a second end and connected by the first end to the hydraulic device;

The second end of the vertical plate flange comprising a first support leg projecting from the housing;

A drive motor positioned in the housing for driving the pump;

The drive motor connected to the vertical plate flange;

The housing having at least one second support leg remote from the first support leg; and The halves of the housing fixedly connected to the hydraulic device.

Preferably, the pump comprises a drive shaft projecting outwardly through an end face of the hydraulic device. The drive shaft extends perpendicularly to the vertical plate flange. The vertical plate flange is form-fittingly connected to the hydraulic device. The drive motor is vertically position-adjustable parallel to the axis of the drive shaft.

The vertical flange has slotted holes in which the drive motor is vertically position-adjustably supported.

The paint spraying device may further comprise a force-transmitting member, wherein the drive motor has an output shaft and wherein the output shaft is coupled by the force-transmitting member to the drive shaft. The force-transmitting member may include a toothed belt, a V belt or a chain.

The housing is preferably vertically divided into two halves in a longitudinal direction of the drive motor. The two halves have horizontal inlet slots at a location remote from the output shaft at a level of the drive motor and/or vertical slot openings in the vicinity of the vertical plate flange and at least one centrally arranged circular outlet opening located above the hydraulic device.

Preferably, the two halves match the contour of the drive motor and the hydraulic device and enclose the drive motor and the hydraulic device at a minimal spacing, i.e., there is only a small gap between the inner wall of the two halves and the outer wall of the hydraulic device or drive motor.

For rotationally fixedly connecting the two halves to the hydraulic device, the hydraulic device comprises mounting supports positioned perpendicularly to the axis of the drive shaft and facing the two halves, respectively. The two halves have counter supports inserted into the respective mounting supports members. The counter supports comprise screws threaded through the two halves into the mounting supports, respectively.

The mounting supports are arranged at corner areas of the hydraulic device remote from the drive shaft.

In one embodiment, the mounting supports have a cylindrical inner mantle surface and the counter supports have a cylindrical outer mantle surface and each half has a securing screw positioned at a distance to the counter supports and engaging the hydraulic device.

Advantageously, the mounting supports have a polygonal cross-section and the counter bearings have matching polygonal cross-sections. The mounting supports are recesses and the counter supports are projections matching the recess, respectively.

The first support leg is positioned on a dividing line between the two halves.

The second support legs are positioned at corners of the housing.

Preferably, the first support leg is an elastic member inserted into the vertical plate flange and the second support legs are elastic members attached to the housing.

Preferably, the two halves have grip portions located remote from the drive shaft and forming together a bracket-shaped grip of the paint spraying device that is downwardly slanted away from a center of the paint spraying device.

The paint spraying device may further comprise a control box formed unitarily within the two halves and positioned below the grip.

According to the present invention, the paint spraying device of the aforementioned kind is improved by providing at the underside of the hydraulic device a vertically projecting plate flange having one end embodied as a one-part or two-part (including two support members) support leg and having secured thereat the drive motor. The hydraulic device and the drive motor are enclosed in a two-part housing (comprised of two half shells or two halves) that, at the side opposite the plate flange, is provided at the level of the first support leg with at least one further support leg of a one-part or two-part construction. The two half shells of the housing, in the area of the hydraulic device, are connected fixedly to the hydraulic device.

It is expedient to embody the vertical plate flange so as to be positioned perpendicularly to the axis of the drive shaft of the conveying pump that extends from the end face of the hydraulic device. The plate flange is preferably almost flush with the outer wall (end face) of the hydraulic device through which the drive shaft extends and preferably form-fitted to the hydraulic device. The drive motor is embodied such that it can be displaced vertically parallel to the axis of the drive shaft, for example, with the aid of slotted holes provided within the plate flange. The output shaft of the drive motor is coupled with a toothed or V belt or a chain to the drive shaft of the conveying pump.

Furthermore, it is suggested to divide the housing in the longitudinal direction of the drive motor vertically and centrally into the two half shells.

In order to be able to cool the drive motor the hydraulic device sufficiently, the two half shells of the housing should be provided at the walls that are positioned opposite to the output shaft of the drive motor at the level of the drive motor with preferably horizontally extending inlet slots and/or in the area of the plate flange with preferably vertically extending inlet or outlet slot openings and in the area above the hydraulic device with at least one, preferably centrally arranged and circularly embodied, outlet opening. The two halves should match the contour of the drive motor and/or of the hydraulic device and enclose the drive motor and hydraulic device at a minimal lateral distance thereto, i.e., with a minimal gap therebetween.

For fixedly connecting the two halves of the housing to the hydraulic device, the hydraulic device should be provided with at least one support arrangement at the outer wall facing the half shells. The support arrangement(s) should extend perpendicularly to the axis of the drive shaft of the conveying pump. The hydraulic device has mounting supports and two half shells have counter supports formed thereat. Screws extending through the counter supports and the half shells are threaded into the respective mounting support. The resulting support arrangements (i.e., mounting support, counter support, and screw) should be arranged in corner areas of the hydraulic device facing away from the drive shaft of the conveying pump.

For cylindrical inner, respectively, outer mantle surfaces of the mounting support and the counter support, respectively, it is suggested to secure or fasten the half shells of the housing with a securing screw positioned at a distance to the mounting support of the hydraulic device. In another embodiment, the mounting support of the hydraulic device and the counter supports of the half shells may have a polygonal inner or outer mantle surface or may be embodied in the form of matching recesses and projections (strip, ledge, bead, ridge, shoulder etc.).

The support legs provided at the plate flange and the two half shells of the housing may comprise elastic supports, for example, shaped as disks or blocks, to be inserted into the support legs centrally or into the end portions. Furthermore, the two halves of the housing can be provided at the side thereof opposite the drive shaft of the conveying pump with grip portions forming a bracket-shaped grip that extending preferably at a slant toward the rear wall of the housing. Below the grip the half shells (two halves) are provided with a unitary control box.

When a paint spraying device is embodied according to the present invention, it can be mounted and assembled in a simple manner within a short period of time by inserting the hydraulic device with drive motor into one of the half shells and by positioning the second half shell thereat. Furthermore, such a paint spraying device is easy to manipulate and suitable for multiple applications. Primarily, it is achieved that the hydraulic device with one side thereof participates in supporting the weight forces and that the half shells of the housing can compensate impacts easily, for example, impacts resulting from a fall. The housing acts in such cases as a dampening means so that damage resulting from mishandling of the device, as is always possible on construction sides, can be substantially prevented.

It is furthermore advantageous that the paint spraying device according to the present invention is of a small size and that essentially all parts, for example, the force-transmitting member in the form of a belt drive, are enclosed by the housing and are thus protected. The cooling air flow of the drive motor can thus also be used for cooling the hydraulic device since the housing acts as a forced guiding system so that the oil volume can be substantially reduced in comparison to known devices. It is possible to use a two-pole electric motor as a drive motor with high rpm but minimal investment expenditure and weight, because its output rpm can be easily adjusted with the aid of the belt drive to the required rpm for operating the conveying pump. Also, without additional constructive expenditure an adaptation to different voltage network frequencies can be carried out because the gear ratio of the belt drive can be easily adjusted, and thus also the rpm of the drive shaft of the conveying pump, to compensate the different output rpm of the output shaft of the drive motor in order to maintain a constant rpm at the pump. With its simple constructive design and the resulting economic manufacture, it is thus possible to provide a paint spraying device of a compact design that has many advantages and can be used in various applications.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
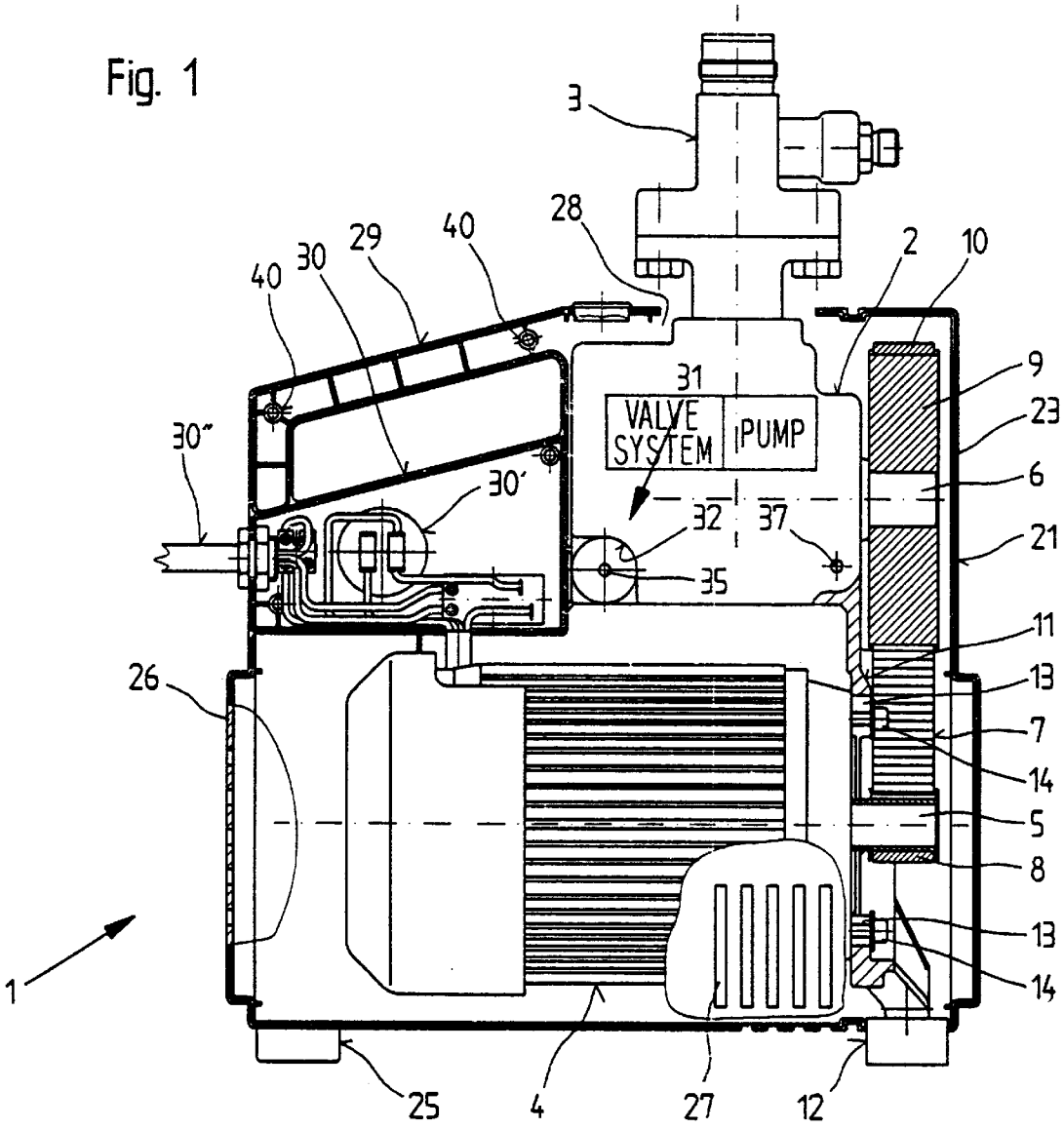
FIG. 1 shows the paint spraying device comprised of a hydraulic device and a coordinated drive motor, partly shown in longitudinal section and partly shown in a side view.
Figure 2:
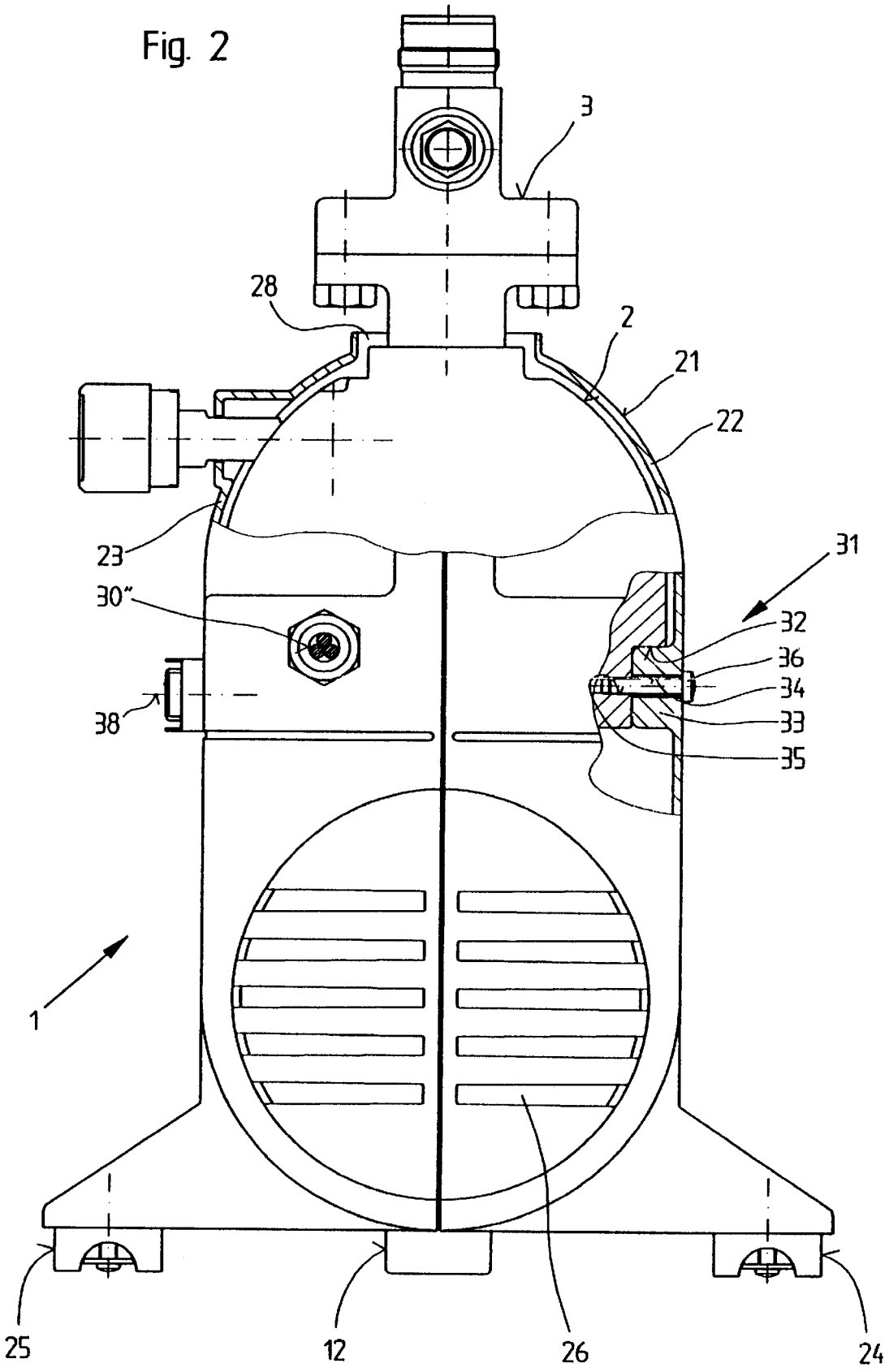
FIG. 2 shows the paint spraying device of FIG. 1 in a side view and partly in section.
Figure 3:
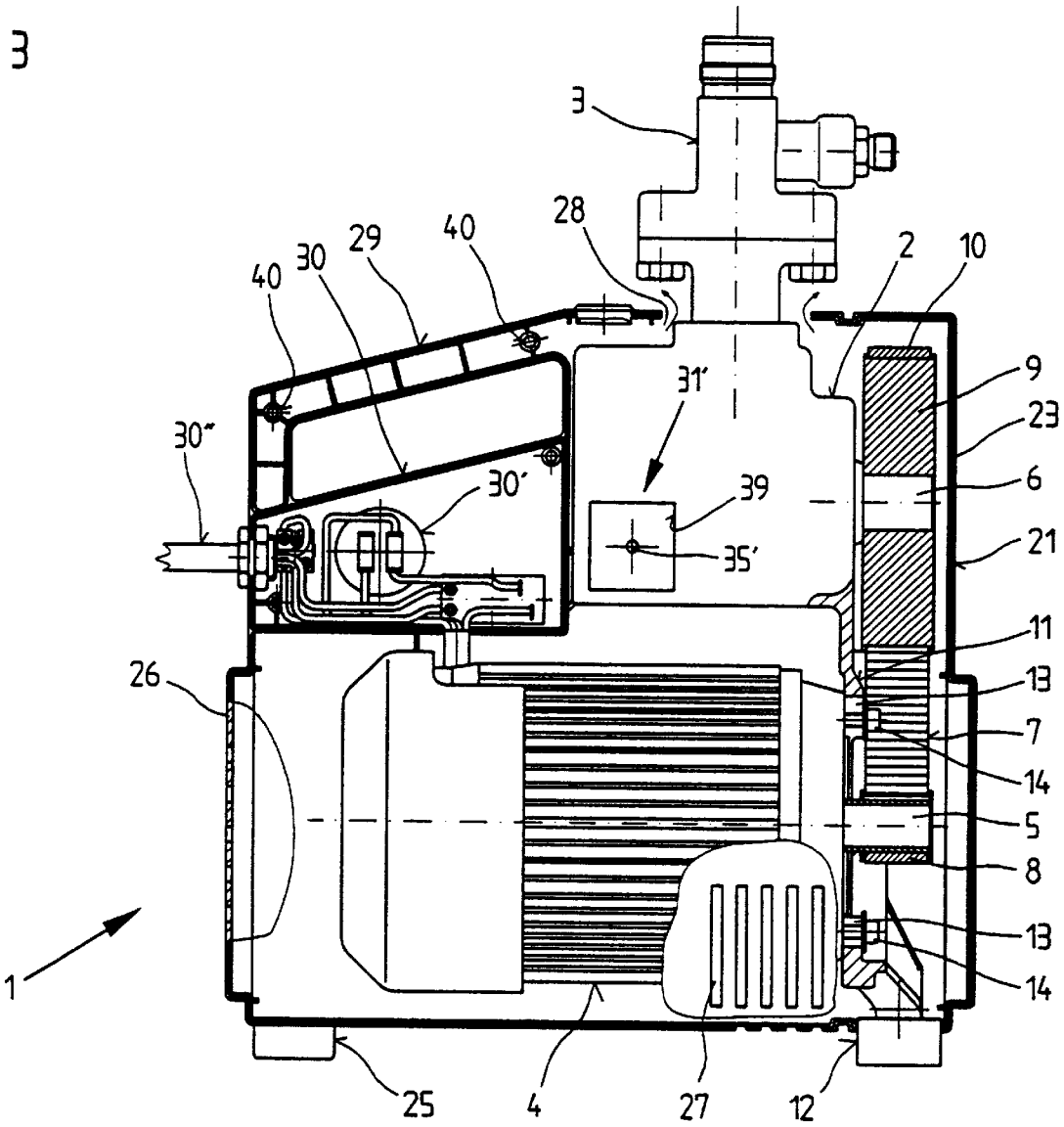
FIG. 3 shows the paint spraying device of FIG. 1 with a different embodiment of the rotationally fixed connection between the hydraulic device and the half shells.

The paint spraying device represented in FIGS. 1, 2, and 3 and identified with reference numeral 1 is used for conveying paints or similar media from a storage device to a hand-held spraying device, for example, a spray gun, and is comprised substantially of a hydraulic device 2 with mounted paint head 3 and a drive motor 4 for the conveying pump mounted within the hydraulic device 2. The drive shaft 6 of the conveying pump which projects from the end face of the hydraulic device 2 is driven by a force-transmitting member in the form of a belt drive 7 via the output shaft 5 of the drive motor 4. The belt drive 7 is comprised of a pulley 8 which is rotationally fixedly connected to the output shaft 5, a pulley 9 which is fastened to the drive shaft 6, and a V belt 10 connecting the two pulleys 8, 9.

The drive motor 4 in the shown embodiment is arranged below the hydraulic device 2 parallel to the axis of the drive shaft 6 of the conveying pump that is loaded by a pressure medium. The hydraulic device 2 also comprises valves coordinated with the conveying pump. The drive motor 4 is secured in an adjustable manner at the plate flange 11 connected to the hydraulic device 2. The plate-shaped flange 11 projects vertically from the hydraulic device 2 and is provided with slotted holes 13 which are penetrated by screws 14 inserted into the drive motor 4. The drive motor 4 is thus height-adjustable so that not only the gear ratio of the belt drive 7 can be changed by exchanging drive components, but an adaptation to different network frequencies can also be provided by changing the gear ratio of the belt drive 7. Due to the fact that the rpm of the output shaft 5 of the drive motor 4 can be reduced by the belt drive 7, a light-weight and inexpensive two-pole electric motor can be used for driving the conveying pump of the paint spraying device 1.

Figure 4:
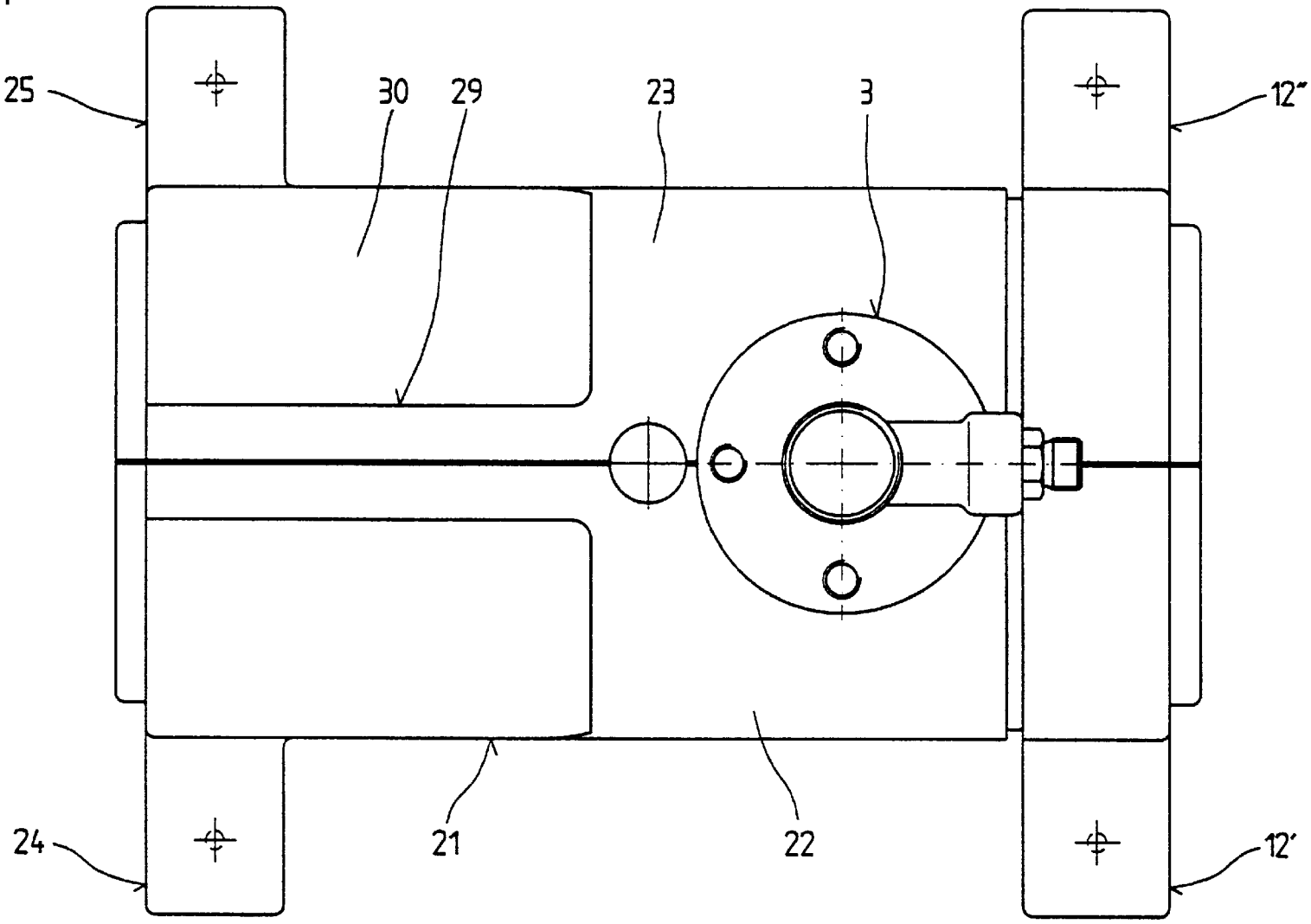
FIG. 4 shows a plan view of the paint spraying device of FIG. 1 in yet another embodiment.

The hydraulic device 2 as well as the drive motor 4 are enclosed in a two-part housing 21 that, as can be seen especially in FIG. 2, is centrally vertically divided and comprised of two half shells (two halves) 22 and 23 that are matched to the contour of the hydraulic device 2 and of the drive motor 4. The two halves 22 and 23 are rotationally fixedly connected to the hydraulic device 2, so that a portion of the weight force of the paint spraying device 1 is thus compensated by the half shells 22 and 23 which, for this purpose, are also provided with support legs 24 and 25. The other portion of the weight force of the paint spraying device 1 is transmitted via flange 11 onto a support surface (ground). According to FIG. 2, the flange 11 comprises a support leg 12 centrally arranged thereat so that a three-point support action is provided together with support legs 24, 25. However, as shown in FIG. 4, the flange 11 can also be provided with a two-part support leg with spaced-apart support members 12' and 12" at its outer areas.

The rotational fixed connection of the two halves 22 and 23 at the hydraulic device 2 is embodied according to the design shown in FIGS. 1 and 2 by providing support arrangements 31. The hydraulic device 2 at its opposite outer walls is provided with mounting supports in the form of recesses 32 that cooperate with counter supports in the form of cylindrical projections 33 connected to the half shells 22 and 23. A clamping screw 36 penetrates the projection 33, respectively, its bore 34 and engages a threaded bore 35 within the hydraulic device, so that each half shell 22 and 23 is individually connected to the hydraulic device 2. With a screw 38 which engages the threaded bore 37, positioned at a distance to the mounting support and represented in the left half of FIG. 2 with a dash-dotted line, the half shells 22 and 23 are fixed, in position.

In the embodiment according to FIG. 3, the fixed attachment of the half shells 22 and 23 to the hydraulic device 2 is achieved with a support arrangement 31' that is comprised of a polygonal, for example, square, recess 39 machined into the hydraulic device 2 and a matching projection formed at the half shells 22 and 23. With a clamping screw inserted into a threaded bore 35' machined into the hydraulic device 2, the two half shells 22 and 23 can be attached to the hydraulic device 2.

In order to cool the drive motor 4 and the hydraulic device 2, the two half shells 22 and 23, at the level of the drive motor 4, are provided with horizontal inlet slots 26 provided at the end face opposite the drive motor 4. Furthermore, each half shell 22 and 23 in the area of the plate flange 11 is provided at the underside with vertically extending slot openings 27. Moreover, the housing 21 at the upper end face is provided with a circular outlet opening 28 concentrically arranged to the connector of the paint head 3. The cooling air flow conveyed by the drive motor 4 is thus not only passed along the drive motor but also along the hydraulic device 2 so that the hydraulic device 2 can also be cooled therewith. Its oil volume can be reduced accordingly.

The two half shells 22 and 23 are furthermore provided with grip portions that form a grip 29 at a side of the housing remote from the drive shaft 6 of the conveying pump. The grip 29 extends at a slant to the rear of the paint spraying device. Below the grip 29, a control box 30 is provided into which an electric line 30" extends. With a switch 30' introduced into the half shell 23, the drive motor 4 can be started. Furthermore, the half 23 is provided with a plurality of threaded bores 40 into which screws that penetrate the half shell 22 can be threaded in order to secure the half shells 22 and 23 relative to one an other.

For assembling the paint spraying device 1, the pre-mounted hydraulic device 2 with the drive motor 4 connected to the plate flange 11 is introduced into the half shell 23. The half shell 23 is fastened with screws 36 and 38 to the hydraulic device 2. Subsequently, the half shell 22 is placed onto the hydraulic device 2 and connected thereto in the same manner. The weight force of the hydraulic device 2, of the paint head 3, and the drive motor 4 is thus not only supported by the plate flange 11 on a support surface (i.e., the ground), but is also partly transmitted, due to the fixed connection of the hydraulic device 2 with the half shells 22 and 23, onto these half shells so that a uniform force distribution results. The half shells 22 and 23 of the housing 21 comprised of impact-resistant plastic can also withstand impact loading resulting, for example, from the paint spraying device 1 falling over without sustaining damage.

The present invention is, of course, in no way restricted to the specific disclosure of the specification and drawings, but also encompasses any modifications within the scope of the appended claims.

What I claim is:

1. A paint spraying device comprising:

a housing comprising two halves;

a hydraulic device mounted in said housing;

said hydraulic device including a valve system and a pump for conveying a medium to be sprayed;

said pump loaded by a hydraulic medium;

a vertical plate flange having a first and second end and connected by said first end to said hydraulic device;

said second end of said vertical plate flange comprising a first support leg projecting from said housing;

a drive motor positioned in said housing and having an output shaft for driving a drive shaft of said pump, wherein said drive shaft and said output shaft extend parallel to one another;

said drive motor connected to said vertical plate flange;

said housing having at least one second support leg remote from said first support leg;

said halves of said housing fixedly connected to said hydraulic device.

2. A paint spraying device according to claim 1, wherein:

said drive shaft projects outwardly through an end face of said hydraulic device:

said drive shaft extends perpendicularly to said vertical plate flange;

said vertical plate flange is form-fittingly connected to said hydraulic device;

said drive motor is vertically position-adjustable so that said output shaft remains parallel to said drive shaft.

3. A paint spraying device according to claim 2, wherein said vertical flange has slotted holes in which said drive motor is vertically position-adjustably supported.

4. A paint spraying device according to claim 2, further comprising a force-transmitting member, wherein said output shaft is coupled by said force-transmitting member to said drive shaft.

5. A paint spraying device according to claim 4, wherein said housing is vertically divided into said two halves in a longitudinal direction of said drive motor.

6. A paint spraying device according to claim 5, wherein said two halves have horizontal inlet slots at a location remote from said output shaft at a level of said drive motor.

7. A paint spraying device according to claim 6, wherein said two halves have vertical slot openings in the vicinity of said vertical plate flange and at least one centrally arranged circular outlet opening located above said hydraulic device.

8. A paint spraying device according to claim 4, wherein said two halves have vertical slot openings in the vicinity of said vertical plate flange and at least one centrally arranged circular outlet opening located above said hydraulic device.

9. A paint spraying device according to claim 5, wherein said two halves match a contour of said drive motor and said hydraulic device and enclose said drive motor and said hydraulic device at a minimal spacing.

10. A paint spraying device according to claim 5, wherein, for fixedly connecting said two halves to said hydraulic device, said hydraulic device comprises mounting supports positioned perpendicular to an axis of said drive shaft and facing said two halves, wherein said two halves have counter supports inserted into said mounting supports, and said counter supports comprise screws threaded through said two halves into said mounting supports.

11. A paint spraying device according to claim 10, wherein said mounting supports are arranged at corner areas of said hydraulic device remote from said drive shaft.

12. A paint spraying device according to claim 10, wherein said mounting supports have a cylindrical inner mantle surface and wherein said counter supports have a cylindrical outer mantle surface, and wherein each one of said two halves has a securing screw positioned at a distance to said counter supports and engaging said hydraulic device.

13. A paint spraying device according to claim 10, wherein said mounting supports have a polygonal cross-section and said counter supports have matching polygonal cross-sections.

14. A paint spraying device according to claim 10, wherein said mounting supports are recesses and said counter supports are projections matching said recesses.

15. A paint spraying device according to claim 5, wherein said first support leg is positioned on a dividing line between said two halves.

16. A paint spraying device according to claim 5, wherein said second support legs are positioned at corners of said housing.

17. A paint spraying device according to claim 5, wherein said first support leg is an elastic member inserted into said vertical plate flange and said second support legs are elastic members attached to said housing.

18. A paint spraying device according to claim 5, wherein said two halves have grip portions located remote from said drive shaft, said grip portions forming together a bracket-shaped grip of said paint spraying device that is downwardly slanted away from a center of said paint spraying device.

19. A paint spraying device according to claim 18, further comprising a control box formed as a unitary part of said two halves and positioned below said grip.

20. A paint spraying device according to claim 1, wherein said first support leg has two spaced-apart support members.

* * * * *